United States Patent [19]

Jackson, Jr.

[11] 4,386,979

[45] Jun. 7, 1983

[54] GAS GENERATING COMPOSITIONS

[76] Inventor: Charles H. Jackson, Jr., 17730 DeWitt Ave., Morgan Hill, Calif. 95037

[21] Appl. No.: 187,797

[22] Filed: Sep. 16, 1980

Related U.S. Application Data

[63] Continuation-in-part of Ser. No. 58,938, Jul. 19, 1979, abandoned, which is a continuation of Ser. No. 911,344, Jun. 1, 1978, abandoned.

[51] Int. Cl.[3] ..... C06B 45/02

[52] U.S. Cl. ..... 149/21; 149/2; 149/61; 149/83; 149/85

[58] Field of Search ..... 149/35, 46, 61, 2, 21, 149/83, 85

[56] References Cited

U.S. PATENT DOCUMENTS

| | | | |
|---|---|---|---|
| 792,511 | 6/1905 | Frank | 149/61 |
| 2,159,234 | 5/1939 | Taylor | 149/46 |
| 2,707,695 | 5/1955 | Courtier | 149/46 |
| 2,988,437 | 6/1961 | Stanley et al. | 149/46 |
| 3,348,985 | 10/1967 | Stadler et al. | 149/46 |
| 3,865,660 | 2/1975 | Lundstrom | 149/35 |
| 3,883,373 | 5/1975 | Sidebottom | 149/35 |
| 3,947,300 | 3/1976 | Passauer et al. | 149/61 |
| 4,078,954 | 3/1978 | Bernardy | 149/116 |
| 4,128,996 | 12/1978 | Garner et al. | 149/83 |
| 4,152,891 | 5/1979 | Garner | 149/83 |

*Primary Examiner*—Edward A. Miller

*Attorney, Agent, or Firm*—Christie, Parker & Hale

[57] ABSTRACT

Gas generating compositions comprising a cyanamide compound and an oxidant therefor. The compositions produce non-toxic, low temperature gases which are especially useful for inflating vehicle passive restraint crash bags.

21 Claims, No Drawings

GAS GENERATING COMPOSITIONS

CROSS-REFERENCE TO RELATED APPLICATIONS

This application is a continuation-in-part of Application Ser. No. 058,938 filed July 19, 1979, which is a continuation of Application Ser. No. 911,344 filed June 1, 1978, both of which are now abandoned. Application Ser. No. 058,938 and Application Ser. No. 911,344 are incorporated herein by this reference.

FIELD OF THE INVENTION

The invention relates to gas generating compositions which, upon combustion, generate non-toxic gases and yield substantially non-corrosive decomposition products. More particularly, the invention relates to gas generating compositions which react to release several or all of the gases nitrogen, carbon dioxide, water, and oxygen at relatively low temperatures. The compositions are especially suited for inflating passive restraint vehicle crash bags and for other inflation uses, such as aircraft escape slides, inflatable boats, and, more generally, for any use where a low temperature, non-toxic gas may be employed to advantage.

BACKGROUND OF THE INVENTION

In current passenger vehicle design, two crash bag modules are typically used. One bag, which inflates to approximately 1 cubic foot in 25 to 35 milliseconds, is mounted in the center of the steering wheel for driver protection and the other bag, which inflates to approximately 10 cubic feet in 60 to 70 milliseconds, is mounted in the right side of the dash for front seat passenger protection.

The methods of inflation currently being used are (1) a compressed gas cylinder augmented by a small charge of solid propellant and (2) a chemical gas generating system utilizing compositions of sodium (or other) azide and an oxidant for generating nitrogen gas. Neither of the foregoing methods has proved to be entirely satisfactory.

The compressed gas devices are necessarily bulky and of complex design. The pressurized cylinder presents hazard problems in shipment, assembly into the vehicle, and vehicle disposal. Because of the difficulty in reliably sealing the pressure cylinder, a pressure monitoring device is normally used in the vehicle to detect gas leakage.

Although the chemical gas generating system obviates the problems associated with the compressed gas system, the use of sodium azide in the chemical system creates other problems. Sodium azide is poisonous when ingested, inhaled as a dust, or absorbed through the skin. In the presence of moisture and an acid environment, sodium azide reacts to form hydrazoic acid, a poisonous gas. Although sodium azide cannot be detonated, contact with many metals, such as copper, lead, and silver may result in the formation of shock- and friction-sensitive explosive azides. In most sodium azide containing gas generating compositions, the solid reaction products contain metallic sodium and sodium oxide, both of which are extremely caustic and reactive. For example, metallic sodium reacts violently with water, liberating flammable hydrogen gas.

The above enumerated properties of azide containing compositions present many problems, particularly in the manufacturing and final disposal processes. Accordingly, it is therefore desirable that a gas generating composition be made available which generates low temperature, non-toxic gases and yields substantially non-corrosive decomposition products.

SUMMARY OF THE INVENTION

This invention relates to a gas generating composition comprising a fuel as a first component, an oxidant as a second component, and a coolant as a third component. The first component is selected from the group consisting of calcium cyanamide, sodium hydrogen cyanamide, and mixtures thereof. The second component is an oxidant and the third component is selected from the group consisting of hydrated aluminum oxide, aluminum oxide, calcium hydroxide, and mixtures thereof.

The gas generating composition provided in accordance with this invention produces non-toxic gases at relatively low temperatures. Additionally, the components of the gas generating composition are non-toxic and the reaction products formed by the components of said gas generating composition are non-toxic and chemically neutral. In addition, the properties of the condensed reaction products of the components of said gas generating composition are such that their entrainment in the gases generated is minimized.

DESCRIPTION OF PREFERRED EMBODIMENTS

The first component of the gas generating composition of the instant invention is an oxidizable gas generating substance, i.e., a fuel selected from the group consisting of compounds of the formula RNHCN where R is hydrogen or nitro, the corresponding dimers and trimers, the metal and ammonium salts thereof and mixtures of such compounds. Gases generated include one or more of the following: $N_2$, $CO_2$, $O_2$, and $H_2O$.

Compounds suitable for use as a first component in the instant invention include, for example, cyanamide compounds such as, for example, cyanamide, dicyanodiamide and melamine; cyanamide salts such as, for example, calcium cyanamide (CaNCN), zinc cyanamide (ZnNCN), and the like; hydrogen cyanamide salts such as calcium hydrogen cyanamide ($Ca(HNCN)_2$), sodium hydrogen cyanamide ($NaHCN_2$), and the like; nitrocyanamide salts such as $Ba(NNO_2CN)_2$ and $NH_4NNO_2CN$; and mixtures of the foregoing compounds. Preferred compounds include sodium hydrogen cyanamide, dicyanodiamide, calcium cyanamide, and mixtures thereof.

The second component of the gas generating composition of the instant invention is an oxidant selected from the group consisting of ammonium-, alkali metal-, alkaline earth metal-, and aluminum nitrates, nitrites, chlorates, perchlorates, manganates and permanganates; iron, nickel and copper oxides; alkaline earth metal peroxides; and mixtures of the foregoing and the like. Preferred oxidants include alkali metal-, ammonium-, alkaline earth metal-, and aluminum nitrates, nitrites, perchlorates and chlorates. Particularly preferred oxidants include $NaNO_3$, $NH_4NO_3$, $NH_4ClO_4$, $NaClO_3$, and mixtures thereof.

Especially preferred oxidants include $NaNO_3$, $NH_4NO_3$ and $NH_4ClO_4$ since the foregoing contribute additional $N_2$, and in some cases $H_2O$, to the gaseous reaction products. In some instances, the oxidant is used in excess of stoichiometry in order to decrease the reaction temperature and add $O_2$ to the gaseous products.

In addition to the above described components, the gas generating compositions of the instant invention can comprise a third component which, when added to the first and second components, effects one or more of the following results:

(i) reduces the reaction temperature by endothermic decomposition and by the heat capacity of the decomposition products;

(ii) provides additional gas from the decomposition reaction;

(iii) reacts with the products of the first and second components and/or other third components or reaction products thereof to yield a chemically neutral solid reaction residue;

(iv) reacts preferentially with a first and second component reaction product such as $Na_2O$ to release $CO_2$ gas which would otherwise be retained as $Na_2CO_3$;

(v) reacts and/or forms solutions with first and second component reaction products and/or other third component reactants or reaction products, thereby modifying the melting, viscosity, and flow characteristics of the solid reaction residue so as to favor retention of the residue in the reaction chamber; and (vi) acts as a diluent which reduces the reaction temperature by virtue of its heat capacity.

Components suitable for use as third components include hydroxides such as, for example, $Ca(OH)_2$ and $Mg(OH)_2$; oxides such as $Al_2O_3$, $SiO_2$ and the like; hydrated oxides such as $Al_2O_3.xH_2O$, $SiO_2.xH_2O$ and $B_2O_3.xH_2O$; hydrated salts such as $CaSO_4.xH_2O$; carbonates such as $CaCO_3$, $MgCO_3$ and $ZnCO_3$; nitrides such as $Ca_3N_2$, $Fe_2N$, $Si_3N_4$, BN and the like; and mixtures of the foregoing compounds. The use of $xH_2O$ in certain formulas hereinabove and below refers to multiple applicable hydrated states, i.e., x could refer to the monohydrates, sesquihydrates, dihydrates, trihydrates, etc.

Specific examples of third component compounds which decompose endothermally and yield $CO_2$, $N_2$, $O_2$ or $H_2O$ when heated include, for example, $CaCO_3$, $Mg(OH)_2$, $Fe_2N$, $Al_2O_3.3H_2O$, $Ca_3N_2$ and $KCLO_4$. Moreover, third component compounds which react with a first and second component reaction product (e.g., $Na_2O$ and/or CaO) to yield a solid reaction residue include the various oxides of aluminum, magnesium, silicon, and boron. Examples of third component compounds which react with a first and second component reaction product to yield a chemically neutral solid reaction residue include $B_2O_3$, $Al_2O_3$ and $SiO_2$. In addition, third component compounds which act as inert diluents include clays and metal powders such as, for example, iron or copper.

Typical examples of reactions between first and second component reaction products and third component reactants are illustrated below:

$$Na_2O + Al_2O_3.3H_2O \rightarrow 3H_2O + 2NaAlO_2 \quad (1)$$

$$Na_2O + SiO_2 \rightarrow Na_2SiO_3 \quad (2)$$

$$CaO + SiO_2.xH_2O \rightarrow xH_2O + CaSiO_3 \quad (3)$$

$$Na_2CO_3 + Al_2O_3 \rightarrow 2NaAlO_2 + CO_2 \quad (4)$$

In reaction sequence (1), the addition of $Al_2O_3.xH_2O$ produces an endothermic reaction which generates water vapor and the neutral reaction product $NaAlO_2$. In reaction sequence (2), the addition of $SiO_2$ also produces a neutral reaction product, i.e., $Na_2SiO_3$. Similarly, in reaction seqeunce (3), the addition of $SiO_2.xH_2O$ results in the generation of water vapor and the production of the neutral reaction product $CaSiO_3$. Moreover, in reaction sequence (4), the addition of $Al_2O_3$ is productive of $CO_2$.

As mentioned previously, it is possible to formulate the gas generating compositions of the instant invention so that the solid decomposition products are inorganic complexes commonly referred to as glasses.

Typical examples of reactions between first and second component reaction products and third component reactants with the formation of glasses are illustrated below:

$$xNa_2O + yBN + zSiO_2 + \frac{3y}{4} O_2 \longrightarrow xNa_2O \cdot y/2B_2O_3 \cdot zSiO_2 \text{ (glassy)} + y/2N_2 \quad (5)$$

$$wNa_2O + xCaO + ySiO_2 + zAl_2O_3 \longrightarrow \text{glasses which are highly viscous in the 1000–1500° C. range} \quad (6)$$

wherein w, x, y, and z denote weight percentages which can be varied widely.

Many of the oxides of the alkali metals, alkaline earth metals, aluminum, magnesium, silicon, and boron are capable of forming these glasses (i.e., viscous solid solutions), thereby affording a reaction residue having a plasticity or viscosity which facilitates retention of the residue in the reaction chamber.

Formulation of the gas generating compositions of the instant invention is accomplished according to the following parameters:

(i) the weight ratio of the first component to the second component (C1/C2) may vary from 0.1 to 3.0. A preferred weight ratio for C1/C2 is from 0.20 to 1.0; and (ii) the amount of the third component is from 0 to 75 percent by weight based on the total amount of the composition, preferably from 10 to 50 percent by weight.

In addition to the foregoing components, the gas generating compositions of the instant invention may contain other ingredients for purposes such as burn rate enhancement, lubricity, and physical strength. Such ingredients will be well known to those skilled in the art to which the invention pertains.

For example, the gas generating composition of the instant invention can comprise a burning rate catalyst selected from the group consisting of manganese dioxide, cupric oxide, iron oxide, and the like, and mixtures thereof. Preferably, the burning rate catalyst comprises from about 0 to no more than about 5% of the total weight of the first, second, and third components of said gas generating composition.

Additionally, if desired, a burn rate modifier such as graphite fiber and/or metal fiber or mixtures thereof or the like can be added to the gas generating composition. These burn rate modifiers conduct heat into unburned portions of the gas generating composition. Generally, the metal fibers are aluminum, iron, or copper, but others can be used if desired.

Preferably, graphite fiber is used because graphite doesn't enter into the reaction of the gas generating composition.

When a burn rate modifier is used, it is preferably in an amount comprising from about 0 to 5% by weight of the total weight of the first, second, and third components of the gas generating composition.

The components of the gas generating compositions of the instant invention are simply mixed together for approximately one-half hour with a common powder blender. After mixing this material, it is then pelletized in a common pressure type pelletizer forming small pellets. The small pellets are then placed into a gas generator of a type which is suitable for inflating vehicle passive restraint crash bags. This gas generator should contain a chamber in which the pellets are to be ignited and burned in order to generate the gas. Also, the gas generator should contain an ignition means to ignite the pellets inside the chamber and a discharge orifice in order to discharge the gas from the chamber into an inflatable crash bag or collection chamber. Gas generators of the type which may be used are described in U.S. Pat. No. 3,117,424, however, other similar type gas generators may be used. After placing the pellets into the gas generator, the composition is ignited. Any general type ignition system may be used.

DESCRIPTION OF SPECIFIC EMBODIMENTS

The following specific description is given to enable those skilled in the art to more clearly understand and practice the present invention. It should not be considered as a limitation upon the scope of the invention, but merely as being illustrative and representative thereof.

Examples of typical interactions between a first component, a second component, and a third component of a gas generating composition will serve to clarify how the components can be combined to achieve the advantages previously described.

Two binary systems of the first and second component reactants are illustrated first. Modifications effected by the addition of typical third component reactants are then presented. Additionally, a preferred gas generating composition comprising a preferred combination of first, second, and third component reactants is described below.

The binary system calcium cyanamide/sodium nitrate reacts essentially according to the following equation within the range of approximately 32.0 to 44.0 weight percent $CaCN_2$. Less than 32.0 weight percent $CaCN_2$ results in the formation of caustic $Na_2O$ and greater than 44.0 weight percent $CaCN_2$ results in the formation of toxic CO.

$$(a)\ CaCN_2 + (b)\ NaNO_3 \longrightarrow (a)\ CaO + \left(\frac{b}{2}\right) Na_2CO_3 + \left(a - \frac{b}{2}\right) CO_2 + \left(a + \frac{b}{2}\right) N_2 + \left(\frac{5b - 6a}{4}\right) O_2.$$

A similar binary system of dicyanodiamide/sodium nitrate reacts essentially according to the following equation within the range of 19.8 to 29.2 weight percent $C_2H_4N_4$. Lesser and greater amounts result in the formation of $Na_2O$ and CO, respectively.

$$(a)\ C_2H_4N_4 + (b)\ NaNO_3 \longrightarrow \left(\frac{b}{2}\right) Na_2CO_3 + \left(2a - \frac{b}{2}\right) CO_2 + 2a(H_2O) + \left(2a + \frac{b}{2}\right) N_2 + \left(\frac{5b - 12a}{4}\right) O_2.$$

The letters a and b in the previous equations denote molar amounts.

Performance data on the above depicted binary systems is as follows:

| | 1 | 2 | 3 | 4 | 5 | 6 | 7 |
|---|---|---|---|---|---|---|---|
| $CaCN_2$, wt. % | 44.0 | 40.0 | 35.0 | 32.0 | — | — | — |
| $C_2H_4N_4$, wt. % | — | — | — | — | 29.2 | 24.8 | 19.8 |
| $NaNO_3$, wt. % | 56.0 | 60.0 | 65.0 | 68.0 | 70.8 | 75.2 | 80.2 |
| Gas, mols/100 g | 1.10 | 1.15 | 1.18 | 1.20 | 2.08 | 1.99 | 1.89 |
| $N_2$, vol. % | 80.0 | 75.2 | 70.2 | 66.7 | 53.3 | 51.9 | 50.0 |
| $CO_2$, vol. % | 20.0 | 13.5 | 4.3 | 0.0 | 13.3 | 7.4 | 0.0 |
| $O_2$, vol. % | 0.0 | 11.3 | 25.5 | 33.3 | 0.0 | 11.1 | 25.0 |
| $H_2O$, vol. % | 0.0 | 0.0 | 0.0 | 0.0 | 33.3 | 29.6 | 25.0 |
| Reaction Temp., °C. | 2300 | 2150 | 1800 | 1600 | 2265 | 1865 | 1380 |
| Burn Rate at 2000 psi, in/sec | 1.1 | 0.8 | 0.6 | 0.4 | 2.+ | 1.+ | 0.5+ |

The addition of third component reactants $Al_2O_3.3H_2O$ and $SiO_2$ to the composition recited in Example No. 6 results in the following reaction sequence:

$$C_2H_4N_4 + 3NaNO_3 + \tfrac{1}{2}\ Al_2O_3.3H_2O + SiO_2 \longrightarrow NaAlO_2 + Na_2SiO_3 + \frac{7}{2}\ N_2 + \frac{7}{2}\ H_2O + 2CO_2 + \tfrac{3}{4}\ O_2.$$

Performance data on the above depicted ternary system is as follows:

| | |
|---|---|
| $CH_4N_4$, wt. % | 17.6 |
| $NaNO_3$, wt. % | 53.4 |
| $Al_2O_3.3H_2O$, wt. % | 16.4 |
| $SiO_2$, wt. % | 12.6 |
| Gas, mols/100 g | 2.20 |
| $N_2$, vol. % | 33.3 |
| $CO_2$, vol. % | 19.1 |
| $O_2$, vol. % | 14.3 |
| $H_2O$, vol. % | 33.3 |
| Reaction Temp., °C. | 1100 |
| Solid Residue | glassy solid, $3Na_2O.Al_2O_3.2SiO_2$ |

A preferred gas generating composition in accordance with this invention comprises as a first component a fuel, i.e., a gas generating substance selected from the group consisting of calcium cyanamide ($CaCN_2$), a hydrogen cyanamide salt of sodium of the formula $NaHCN_2$, and mixtures thereof. The preferred gas generating composition comprises as a second component the oxidant $NaNO_3$ and as a third component a coolant selected from the group consisting of aluminum oxide ($Al_2O_3$), hydrated aluminum oxide ($Al_2O_3.xH_2O$), calcium hyroxide ($Ca(OH)_2$), and mixtures thereof.

Preferably, the first component comprises between about 27 percent and about 35 percent by weight of the total combined weight of the first, second, and third components of the gas generating composition. If the fuel, i.e., the first component, comprises less than about 27 percent by weight, as described above, it has been found that the rate of burning of the composition is lower than desired, resulting in a less than desired rate of inflation of a crash bag. If the fuel comprises more than about 35 percent by weight, as described above, the temperature of the gas formed when the fuel is burned is higher than desired.

Although the preferred embodiment of a gas generating composition can comprise $CaCN_2$ by itself, $NaHCN_2$ by itself, or mixtures of $CaCN_2$ and $NaHCN_2$, it is most preferred that $NaHCN_2$ be used by itself as the first component.

When selecting the most preferred first component of the gas generating composition, several parameters are considered, inter alia the burn rate of the fuel and also the amount of $CO_2$ resulting from combustion of the gas generating mixture.

The amount of $CO_2$ produced is important because it is thought that the automotive industry intends to introduce specifications for gas generating compositions for use in crash bags. It is believed that these specifications will include limits on the percent by volume of $CO_2$ that can be produced by burning a gas generating composition as compared to the total volume of gas produced. It is thought that the maximum percent by volume of $CO_2$ will be between 5% and 10%.

It is preferred that $NaHCN_2$ be used alone as the first component of a gas generating composition, firstly because the burn rate of $NaHCN_2$ is desirably higher than the burn rate of $CaCN_2$. Secondly, when $CaCN_2$ is used along, as the first constituent, or in combination with $NaHCN_2$, more $CO_2$ results than when only $NaHCN_2$ is used as the first constituent. This is because sodium ties up some $CO_2$ as $Na_2CO_3$. Therefore, it is preferred that $NaHCN_2$ be used alone as the first constituent to reduce the amount of $CO_2$ gas resulting from the reaction of the gas generating composition.

If $CaCN_2$ is used in combination with $NaHCN_2$, then preferably no more than about 50% by weight of the first component is $CaCN_2$ with the remainder being $NaHCN_2$.

Preferably, as described above, the second component of a preferable gas generating composition is $NaNO_3$. $NaNO_3$ is preferred because when used in combination with either $NaHCN_2$ or $CaCN_2$ or mixtures thereof, a higher burn rate results than when other above mentioned second component oxidants are used. Additionally, when the second component is $NaNO_3$, nitrogen gas is formed and the sodium ties up a part of the $CO_2$ produced.

It is preferred that the $NaNO_3$ comprise between about 43 percent and about 55 percent by weight of the total combined weight of the first, second, and third components of the gas generating composition.

When the oxidant, i.e., the $NaNO_3$, comprises more than about 55 percent by weight of the total combined weight of the first, second, and third components of the gas generating composition, undesirable nitrogen oxides are formed. On the other hand, when $NaNO_3$ comprises less than about 43 percent by weight of the total combined weight of the first, second, and third components of the gas generating composition, carbon monoxide is formed. Both oxides of $N_2$ and CO are undesirable because they are toxic.

Preferably, the third component, i.e., the coolant $Al_2O_3.xH_2O$ and/or $Al_2O_3$ and/or $Ca(OH)_2$, and mixtures thereof, comprise from about 10 percent to about 30 percent by weight of the total combined weight of the first, second, and third components of the gas generating composition.

It is not desired that less than about 10 percent by weight of the total weight of the first, second, and third constituent of the gas generating composition is coolant because at less than about 10 percent, the gas formed is hotter than desired as it fills the crash bag.

Preferably, the third component comprises $Al_2O_3.H_2O$ or a mixture of $Al_2O_3.3H_2O$ and $Al_2O_3$. The proportions of $Al_2O_3.3H_2O$ and $Al_2O_3$ can be chosen to result in formation of any desirable amount of water from the reaction of the preferred gas generating composition.

Additionally, having aluminum present from $Al_2O_3$ and/or $Al_2O_3.xH_2O$ is desirable since $NaAlO_2$ is formed as a reaction product. This is desirable because, when excess sodium is present, it can result in the formation of sodium hydroxide.

$NaAlO_2$ is a glassy slag which barely melts at the flame temperature of the preferred gas generating composition.

Although $Ca(OH)_2$, when used as a coolant, results in a faster burn rate at the same flame temperature, as when $Al_2O_3$ and/or $Al_2O_3.xH_2O$ is used as a coolant, the CaO formed does not react with $Na_2O$ and does not form a glassy slag. The reaction product, $NaAlO_2$, stays in the chamber of the gas generator better than CaO, resulting in less particulate matter in a crash bag after the gas composition is burned.

In addition to the first, second, and third components of a preferred gas generating composition, a burn rate catalyst and/or a burn rate modifier can be added to the composition if desired, as described above.

A gas generating composition having the preferred first, second, and third components present in their selected weight ranges relative to each other burns with a flame temperature in the range of from about 1200° C. to about 1600° C.

The reaction products produced by such a preferred gas generating composition fall within the following range:

| | |
|---|---|
| $N_2$, vol. % | 50–65 |
| $H_2O$, vol. % | 25–40 |
| $Co_2$, vol. % | 5–10 |
| $O_2$, vol. % | 0–5 |
| CO, ppm | 250–1000 |
| $NO_x$, ppm | 50–200 |
| $NH_3$, ppm | 0–10 |
| HCN | Not detectable |

A more preferred gas generating composition in accordance with this invention comprises as a first constituent about 31% by weight $NaHCN_2$, as a second constituent about 50% $NaNO_3$, and as a third constituent about 19% of $Al_2O_3.H_2O$ or a mixture of $Al_2O_3.3H_2O$ and $Al_2O_3$. The relative amounts of $Al_2O_3.3H_2O$ and $Al_2O_3$ are selected to give a desired amount of water as a reaction product.

Additionally, to the first, second, and third components can be added a burn rate catalyst such as cupric oxide and/or a burn rate moderator in amounts as described above.

The term "cyanamide compound" as used hereinabove and below refers to those compounds included within the definition of the first component as set out in the specification and claims.

The use of the cyanamide compounds as the principal oxidizable constituent in the gas generating composition of the instant invention is primarily responsible for the following desirable characteristics:

The reactants, both separately and in intimate contact with each other, are non-toxic, non-corrosive, chemically stable, and insensitive to shock and friction;

The reactants are currently manufactured in large production quantities and are readily available at very low cost;

The gaseous products are produced at concentrations which present no inhalation, burn, or flammability hazard;

The relatively high gas yield favors compact, light-weight design of the gas generator;

The relatively high burn rate favors low operating pressure and, therefore, safer and lighter-weight design of the gas generator;

The relatively low gas temperature simplifies gas cooling design problems;

The rheology of the condensed reaction products is such that the resultant residue is readily retained in the reaction chamber, thereby minimizing mechanical filtration design problems; and Neither the gas generating composition nor the reaction products present a disposal hazard to personnel, equipment, or the environment.

I claim:

1. A combustible gas generating composition consisting essentially of:

a fuel as a first component, an oxidant as a second component, and a coolant as a third component, and optionally other ingredients for burn rate enhancement, lubricity, or physical strength, wherein:

the first component is selected from the group consisting of calcium cyanamide, sodium hydrogen cyanamide, and mixtures thereof, said first component comprising from about 27 percent to about 35 percent by weight of the total combined weight of said first, second and third components; and the second component comprises sodium nitrate, said second component comprising from about 43 percent to about 55 percent by weight of the total combined weight of said first, second, and third components; and the third component is selected from the group consisting of hydrated aluminum oxide, aluminum oxide, calcium hydroxide, and mixtures thereof, said third component comprising from about 10 percent to about 30 percent by weight of the total combined weight of said first, second, and third components.

2. A gas generating composition according to claim 1 wherein:

the first component is sodium hydrogen cyanamide, wherein said sodium hydrogen cyanamide comprises about 31 percent by weight of the total combined weight of said first, second, and third components;

sodium nitrate comprises about 50 percent by weight of the total combined weight of said first, second, and third components; and the third component comprises about 19 percent by weight of the total combined weight of said first, second, and third components.

3. A gas generating composition according to claim 2 wherein the third component is selected from the group consisting of hydrated aluminum oxide, aluminum oxide, and mixtures thereof.

4. A gas generating composition according to claim 1 wherein no more than about 50 percent by weight of the first component is calcium cyanamide.

5. A gas generating composition according to claim 1 wherein no more than about 50 percent by weight of the third component is calcium hydroxide.

6. A gas generating composition according to claim 1 having a burning rate catalyst selected from the group consisting of manganese dioxide, cupric oxide, iron oxide, and mixtures thereof, said burning rate catalyst comprising less than about 5 percent by weight of the total combined weight of said first, second, and third components.

7. A gas generating composition according to claim 1 having a burning rate modifier selected from the group consisting of graphite fibers, metal fibers, and mixtures thereof, said burning rate modifier comprising less than about 5 weight percent of the total combined weight of the first, second, and third components.

8. A combustible gas generating composition consisting essentially of a fuel as a first component, an oxidant as a second component, and a coolant as a third component, and optionally other ingredients for burn rate enhancement, lubricity, or physical strength, wherein:

(a) the first component is selected from the group consisting of calcium cyanamide, sodium hydrogen cyanamide, and mixtures thereof, said first component comprising about 31 percent by weight of the total combined weight of the first, second and third components;

(b) the second component comprises sodium nitrate, said second component comprising about 50 percent by weight of the total combined weight of the first, second, and third components; and (c) the third component is selected from the group consisting of hydrated aluminum oxide, aluminum oxide, calcium hydroxide, and mixtures thereof, said third component comprising about 19 percent by weight of the total weight of the first, second, and third components.

9. A gas generating composition according to claim 8 wherein no more than about 50 percent by weight of the first component is calcium cyanamide.

10. A gas generating composition according to claim 8 wherein no more than about 50 percent by weight of the third component is calcium hydroxide.

11. A gas generating composition according to claim 8 having a burning rate catalyst selected from the group consisting of manganese dioxide, cupric oxide, iron oxide, and mixtures thereof, said burning rate catalyst comprising less than about 5 percent by weight of the total combined weight of the first, second, and third components.

12. A gas generating composition according to claim 11 additionally comprising a burning rate modifier selected from the group consisting of graphite fibers, metal fibers, and mixtures thereof, said burning rate modifier comprising less than about 5 percent by weight of the total combined weight of the first, second, and third components.

13. A combustible gas generating composition consisting essentially of:

a first component selected from the group consisting of calcium cyanamide, sodium hydrogen cyanamide, and mixtures thereof;

a second component selected from the group consisting of alkali metal and alkaline earth metal nitrates, nitrites, chlorates, and perchlorates in a quantity sufficiently near a stoichiometric ratio relative to the first component to generate the non-toxic gases upon combustion; and a third component selected from the group consisting of hydrated aluminum oxide, aluminum oxide, calcium hydroxide, and mixtures thereof; and optionally other ingredients for burn rate enhancement, lubricity, or physical strength.

14. A gas generating composition according to claim 13 wherein:

the first component is sodium hydrogen cyanamide, said sodium hydrogen cyanamide comprising from about 27 percent to about 35 percent by weight of the total combined weight of said first, second and third components;

the second component is sodium nitrate, said sodium nitrate comprising from about 43 percent to about 55 percent by weight of the total combined weight of said first, second, and third components; and the third component is selected from the group consisting of hydrated aluminum oxide, aluminum oxide, and mixtures thereof, said third component comprising from about 10 percent to about 30 percent by weight of the total combined weight of said first, second and third components.

15. A gas generating composition according to claim 13 wherein no more than about 50 percent by weight of the first component is calcium cyanamide.

16. A gas generating composition according to claim 13 wherein no more than about 50 percent by weight of the third component is calcium hydroxide.

17. A gas generating composition according to claim 13 having a burning rate catalyst selected from the group consisting of manganese dioxide, cupric iron oxide, and mixtures thereof, said burning rate catalyst comprising less than about 5 percent by weight of the total combined weight of said first, second, and third components.

18. A gas generating composition according to claim 13 having a burning rate modifier selected from the group consisting of graphite fibers, metal fibers, and mixtures thereof, said burning rate modifier comprising less than about 5 percent by weight of the total combined weight of the first, second, and third components.

19. A combustible gas generating composition consisting essentially of:

a first component, a second component, and a third component, wherein:

the first component is sodium hydrogen cyanamide;

the second component is an oxidant selected from the group consisting of:

ammonium, alkali metal, alkaline earth metal, magnesium and aluminum nitrates, nitrites, chlorates, perchlorates, and manganates; iron, nickel and copper oxides; alkaline earth metal peroxides and mixtures thereof; and the third component is a compound selected from the group consisting of hydrated aluminum oxide, aluminum oxide, calcium hydroxide, and mixtures thereof; and optionally other ingredients for burn rate enhancement, lubricity, or physical strength.

20. A gas generating composition according to claim 19 wherein:

sodium hydrogen cyanamide comprises from about 27 percent to about 35 percent by weight of the total combined weight of said first, second, and third components;

the second component is sodium nitrate wherein said sodium nitrate comprises from about 43 percent to about 55 percent by weight of the total combined weight of said first, second, and third components; and the third component comprises from about 10 percent to about 30 percent by weight of the total combined weight of said first, second, and third components.

21. A gas generating composition according to claim 19 wherein no more than about 50 percent by weight of the third component is calcium hydroxide.

* * * * *

UNITED STATES PATENT AND TRADEMARK OFFICE

CERTIFICATE OF CORRECTION

PATENT NO. : 4,386,979

DATED : June 7, 1983

INVENTOR(S) : Charles H. Jackson, Jr.

It is certified that error appears in the above—identified patent and that said Letters Patent is hereby corrected as shown below:

Column 10, line 63, claim 12, "additionally comprising" should read -- having --.

Signed and Sealed this

*Sixteenth* Day of *August 1983*

[SEAL]

*Attest:*

GERALD J. MOSSINGHOFF

*Attesting Officer*

*Commissioner of Patents and Trademarks*